United States Patent [19]

Senolt et al.

[11] 3,935,093

[45] Jan. 27, 1976

[54] BITUMEN BLOWING

[75] Inventors: Hans Senolt; Heinrich Tomaschko; Georg Palvik, all of Vienna, Austria

[73] Assignee: Osterreichische Mineralolverwaltung Aktiengesellschaft, Vienna, Austria

[22] Filed: Dec. 14, 1972

[21] Appl. No.: 315,008

Related U.S. Application Data

[63] Continuation of Ser. No. 78,035, Oct. 5, 1970, abandoned.

[30] Foreign Application Priority Data

Oct. 3, 1969 Austria ..... 9332/69

[52] U.S. Cl. ..... 208/6

[51] Int. Cl.[2] ..... C10G 27/00

[58] Field of Search ..... 208/6

[56] References Cited

UNITED STATES PATENTS 2,095,190 10/1937 Heuscher ..... 208/6

OTHER PUBLICATIONS

Calderbank, Trans. Inst. Chem. Engineers, Vol. 36, p. 444, 1958.

*Primary Examiner*—Veronica O'Keefe

*Attorney, Agent, or Firm*—Holman & Stern

[57] ABSTRACT

A bitumen blowing method comprises blowing air into a body of bitumen to produce an upward flow of bitumen relatively rich in air and a downward flow of bitumen relatively poor in air. The upward flow is agitated to disperse the air therein. A bitumen blowing reactor suitable for carrying out the method comprises a reactor vessel having an air inlet, a dispersion container in the vessel, the dispersion container having a floor provided with a passage therethrough, and bitumen-agitating means disposed in the container. The air inlet is arranged to discharge below the passage. One or more additional dispersion containers each having bitumen agitating means disposed therein may be provided above the first-mentioned container.

3 Claims, 2 Drawing Figures

BITUMEN BLOWING

Figure 1:
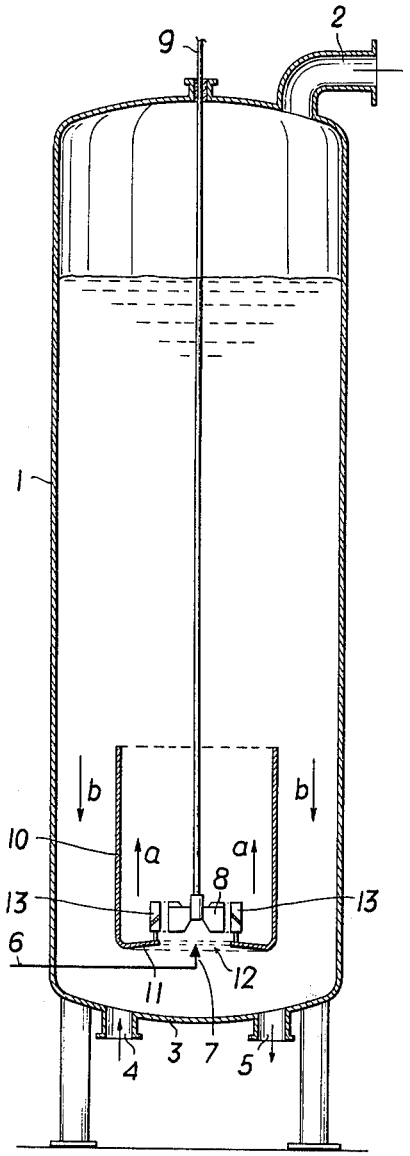

This is a continuation of application Ser. No. 78,035, filed Oct. 5, 1970, now abandoned.

The present invention relates to a bitumen blowing method in which air is blown into a body of bitumen to produce an upward flow of bitumen relatively rich in air and a corresponding downward flow of bitumen relatively poor in air. The invention also relates to a bitumen blowing reactor for carrying out the method.

Bitumen is a very viscous liquid or a solid, consisting essentially of hydrocarbons and their derivatives, which is soluble in carbon disulphide. It is substantially non-volatile and softens gradually when heated. It is black or brown in colour and possesses waterproofing and adhesive properties. It is obtained principally by refinery processes from petroleum, and is also found as a natural deposit or, in association with mineral matter as a component of naturally occurring asphalt.

Asphalt is a natural or mechanical mixture of bitumen with a substantial proportion of solid mineral matter.

It is well known that bitumen blowing is used to produce asphaltic bitumen of a desired consistency from what is known as soft bitumen. The size of the area of contact, the exchange surface, between the hot soft bitumen and the air forced into it is a critical factor in determining the time the bitumen blowing takes and the quantity of air used.

There are two conventional methods of finely dispersing the air in the bitumen during bitumen blowing:

a. immediate fine dispersion by means of jets or nozzles which may be in the form of perforated tubes such as spinnerets or rings, or by means such as filter plates, sinter plates, or ejectors. The force required for dispersion of the air is achieved by increasing the air pressure substantially above the hydrostatic pressure of the bitumen by using an air compressor. Such an air compressor has an efficiency of only about 0.5.

b. Preliminary course dispersion in which the air pressure is only slightly higher than the hydrostatic pressure of the bitumen, followed by a fine dispersion by mechanical means, such as agitator vanes or turbines. The dispersion effect achieved by the mechanical means is thus combined directly with the blowing process and the effectiveness of the mechanical means is approximately 0.95.

Each of the two methods (a) and (b) has, moreover, special advantages and disadvantages. However, in both cases optimum air dispersion can only be achieved at a certain gas pressure $V_Q$ which is determined by the ratio of the quantity of air flowing in per second (cm3/sec.) to reaction area (cm2). Any increase in the rate of airflow per second has the effect of enlarging the diameter of the air jet $d_{B1}$ and hence reducing the specific area $a$ of the air bubbles, which means that the degree of exploitation of the air is lowered. The specific area is defined, as is well known, by the ratio of the surface of air bubbles to the volume of the bubbles, i.e.

$$a = \frac{d_{B1}^2 \cdot \pi}{\frac{d_{B1}^3 \cdot \pi}{6}} = \frac{6}{d_{B1}} \text{ [cm}^{-1}\text{]}$$

In the case of method (a), the rate of airflow is associated with an increase in the air pressure, i.e. with an increase in desired air compressor efficiency, whereas in the case of method (b), the efficiency required of the agitator system decreases as the rate of airflow increases, while the air pressure, which only corresponds to the hydrostatic pressure of the bitumen, remains the same.

It is, however, impossible in the practice of bitumen blowing to avoid varying the amount of air blown in since the conditions of the reaction have to be varied according to the quality of the raw materials used or of the finished product required. In the case of method (a) however, a variation in the rate of airflow which is coupled with optimum air distribution is only possible if structural modifications are made to the apparatus in that, for example, either the size or number of jets are altered.

The present invention is based on method (b) and involves the use of an agitator mechanism. According to Calderbank "the interfacial area in gas-liquid contacting with mechanical agitation" (Transactions Institution of Chemical Engineers, Vol. 36, 1958, page, 444), the average diameter of air bubbles which can be obtained when liquids are acted upon by a jet in conjunction with mechanical agitators is $$d_{B1} = \frac{C \cdot \sigma^{0.6}}{\frac{(L)^{0.4}}{V} \cdot \rho^{0.2}_{Dis}}$$

when C is an apparatus constant, $\sigma$ the surface tension of the liquid, L the power consumption of the agitator, V the dispersion volume and $\rho_{Dis}$ the dispersion density.

Since for a given quality of bitumen and with a certain reaction temperature the surface tension $\sigma$ will be fixed, while the dispersion density $\rho_{Dis}$ will also take on a certain fixed value for a given rate of airflow, the remaining parameters influencing the diameter of the air bubbles, will be the power consumption of the agitator L and the dispersion volume V. Thus in order to achieve the aim of a specific area $a$ which is as large as possible, which is the same as an air bubble diameter $d_{b1}$ which is as small as possible, either L must be kept very high or V very low in value.

The aim of the present invention is to ensure that the air bubbles are of as small a diameter as possible by correspondingly reducing the dispersion volume, without thereby detrimentally affecting the efficiency of the apparatus and the quality of the asphaltic bitumen produced.

Accordingly the invention provides a bitumen blowing method in which: air is blown into a body of bitumen to produce an upward flow of bitumen relatively rich in air and a corresponding downward flow of bitumen relatively poor in air; and the upward flow is agitated to disperse the air therein.

Only a small volume requires agitation so that the power required for agitation may be substantially reduced, since the work of distribution in a small dispersion volume is correspondingly smaller, while a satisfactory average air bubble diameter $d_{B1}$ already obtained is not enlarged. Although the power requirements are substantially reduced, the product obtained is of the same quality as those obtained in conventional blowing processes. The reasons why this is so are as follows:

Each of the air bubbles dispersed in the hot bitumen rises more or less rapidly to the surface of the mixture because of the difference in density between bitumen and air. In doing so it draws bitumen behind it. If the air bubble now bursts at the surface of the mixture, the bitumen which it has drawn upwards and which is now free of air has to flow downwards again. It is now possible to distinguish five different zones in the flow within the reactor, viz. a zone of turbulent, downwardly flowing bitumen containing little or no air which is located within the zone of action of the agitator mechanism along the internal wall of the reactor, a zone of turbulent centrally upward-flowing bitumen containing air bubbles within the zone of action of the agitator mechanism, a zone of straight centrally upward-flowing bitumen mixture containing air produced by the agitator mechanism, a zone of straight, downward-flowing bitumen with little or no air content along the internal wall of the reactor vessel, and a zone of turbulent bitumen containing air on the boundary surfaces between the said straight upward flow and the said straight downward flow.

It is now clear however that any effort expended on distribution or agitation at least in the first zone of turbulent, downward flowing bitumen with little or no air content flowing along the internal wall of the reactor vessel is wasted. The method of the invention, according to which only the air rich rising flow, i.e. the turbulent flow of bitumen containing air bubbles at the centre, is agitated, avoids any superfluous agitation without effect.

Advantageously in this method the air-rich rising flow may be separated from the downward flow of bitumen with little or no air content, at least in the area of agitation. This means that the substance requiring agitation is spatially defined so that when the air bubbles remain the same the work of distribution is correspondingly reduced.

The device for use with the method, which is conventionally provided with a built-in agitator mechanism, is characterised in that the agitator mechanism is arranged within a container which serves to separate the two flows, the air inlet discharging into the reactor vessel below a passage provided in the funnel-shaped upwardly extending floor of the container. Advantageously the agitator mechanism may be arranged directly above the passage since this ensures particularly effective agitation.

Tests have shown that the diffusion processes which are decisive for the effectiveness of the blowing process occur almost exclusively in the zone of the turbulent upward flow of bitumen rich in air bubbles in the range of action of the agitator and that the zone of straight upward flow of mixture containing air produced by the agitator only makes a small contribution to the success of the process, while the zone of turbulent downward flow which contains little or no air and moves along the internal walls of the reactor vessel and the zone of straight downwardly flowing bitumen on the walls of the reactor vessel which contains little or no air, as also the zone of undirected, air-containing bitumen on the boundary surfaces between the said straight upward and straight downward flows are markedly free from any reaction. In one embodiment of the invention a number of dispersion containers arranged one above the other and preferably coaxially so that their walls continue each other may be provided with passages in their floors which extend upwards in the form of funnels, each such container housing an agitator mechanism and all agitators being driven through a common shaft. This makes it possible almost completely to eliminate the zones in which little or no reaction occurs, as specified above, and this substantially increases the output per cubic meter useful capacity of the reactor vessel.

Figure 2:
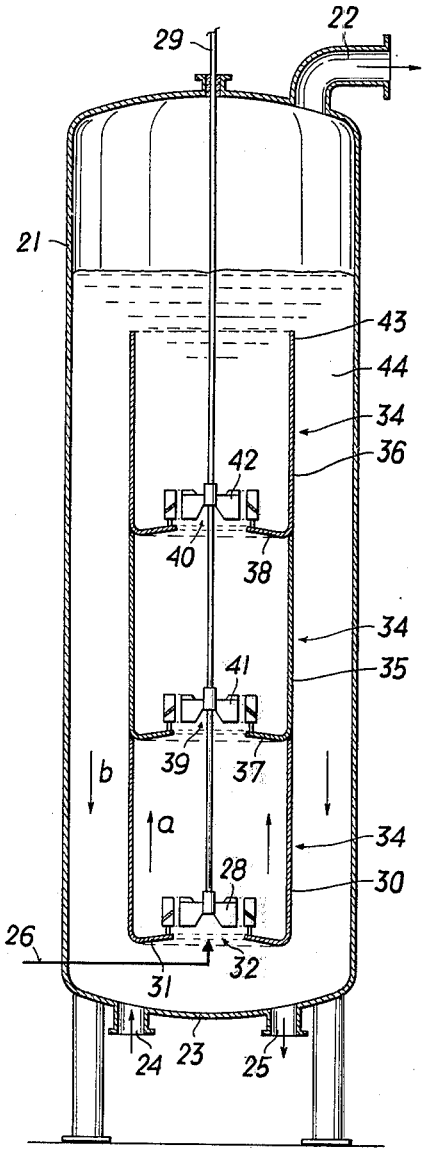

The invention will now be described by way of example with reference to the accompanying drawings, in which:

FIG. 1 shows a vertical section through a bitumen blowing reactor according to the invention; and FIG. 2 shows a vertical section through another bitumen blowing reactor according to the invention.

Referring to FIG. 1, a cylindrical reactor vessel 1 is provided with an air offtake 2 on the upper part of the reactor vessel 1. The base 3 of the vessel has a charging aperture 4 through which bitumen to be treated i.e. the soft residues of petroleum distillation which it is desired to convert into asphaltic bitumen of a desired degree of hardness, may be pumped into the vessel 1. The asphaltic bitumen thus produced may be removed through a discharge aperture 5 in the base 3 of the reactor vessel 1. The lower portion of the reactor vessel 1 is provided with an air inlet 6. An end 7 of the inlet 6 is located below an agitator 8 in the form of a vane mixer is driven through a shaft 9. The lower portion of the reactor vessel 1 contains a dispersion container 10 which serves to separate an upward bitumen flow *a* and a downward bitumen flow *b* and is coaxial with the shaft 9. The container 10 has a funnel-shaped floor 11, extending upwards to a passage 12 provided therein. The agitator mechanism 8 is arranged within the dispersion container 10 directly above the passage 12. A fixed portion 13 of the agitator 8 is secured to the floor 11.

Air is conveyed into the reactor vessel 1 through the air inlet 6 at a pressure just sufficient to overcome the hydrostatic pressure of the column of bitumen in the vessel 1 and forms large bubbles which are broken up into smaller bubbles by the agitator 8. This results in the formation of the upward flow *a* which is relatively rich in air and the downward flow *b* which contains little or no air. Only the upward flow *a* is agitated. Adjacent the agitator the two flows *a* and *b* are separated by the container 10. This reduction in the volume of substance to be agitated results in a considerable saving in energy without the quality of the blown bitumen being in any way impaired.

Referring to FIG. 2, a reactor vessel 21 is provided with an air offtake 22 a base 23 and charging and discharge apertures 24 and 25 respectively. Three dispersion containers 30, 35 and 36 are arranged coaxially one above the other so that their walls 34 are contiguous. Each container has a funnel-shaped floor 31, 37 38 or extending upwards to a passage 32, 39 or 40 provided therethrough. The air inlet 26 discharges below the passage 32 of the lowest container 30, into the reactor vessel 21. Each of the containers 30, 35 and 36 houses an agitator mechanism 28, 41 or 42 and all the agitators are driven through a common shaft 29. Fixed portions of the agitator mechanisms are secured to the floors 31, 37 and 38 of the containers.

Air is fed into the reactor vessel 21 through the inlet 26 and is finely distributed by the agitator mechanism 28 and the mixture of bitumen and air thus produced rises within the container 30.

Air bubbles of small diameter reach the floor 37 of the next higher container 35 where they form relatively large air pockets or sacs which slide over the funnel-shaped floor to the passage 39, thus reaching the agitator mechanism 41 in the dispersion container 35 which is in the form of a redispersing vane system which again divides the air pockets or sacs into small bubbles, i.e. re-disperses them. The processes described take place in the container 35 and are repeated in the container 36. The mixture of bitumen and air which rises in the container 36 rises above the edge 43 of the uppermost container and the air is liberated at the surface of the contents of the reactor vessel, thereby producing bitumen with little or no air content which flows downwards in the annular space 44 between the internal wall of the reactor vessel and the containers; when it reaches the lower regions of the vessel, air is again forced in.

As has already been stated, a reactor of this type makes it possible almost completely to eliminated the zones in which little or not reaction occurs.

The following are the results of comparative tests:

a. In a blowing reactor vessel equipped according to the latest state of the art and having an agitator for distribution of fresh air in the form of a dispersal turbine and a redispersal turbine, the power requirements during blowing when the peripheral speed . . . of the turbine wheels is 4.6 meters per sec. were:

$L_m$ = 23.0 kw, i.e. 11.5 kw per turbine.

The output from the reactor used for blowing soft bitumen B 200 (softening point, ring and ball. 39°C, penetration at 25°C: 200 1/10mm) to give a medium *b* 85 bitumen (softening point ring and ball 47°C, penetration at 25°C: 85 1/10mm) at a reaction temperature of 250°C was 9500 kg per day and ton of reactor vessel contents.

b. In a reactor equipped according to the invention with three dispersal containers (one fresh air dispersal vane system and two re-dispersal systems) the power requirements during blowing when the peripheral speed of the turbine wheels remained the same (4.6m/sec.) were $L_m$ = 15.8 kw, i.e. 5.3 kw per turbine.

The output from the reactor vessel equipped according to the invention with three dispersal containers and used for blowing soft bitumen B 200 by the same process as described under (a) above was found to be 15,600 kg per day and ton of useful reactor capacity.

We claim:

1. A bitumen blowing method comprising: providing a body of bitumen, providing a spatially defined central portion in said body of bitumen, blowing air into said spatially defined central portion at a pressure sufficient to overcome the hydrostatic pressure of the bitumen, thereby producing within the body of bitumen an upward flow of a mixture of bitumen and air and a corresponding downward flow of bitumen relatively poor in air compared to the upwardly flowing mixture and mechanically agitating the upwardly flowing mixture within the spatially defined central portion to disperse the air therein.

2. A method according to claim 1, wherein the upward flow is separated from the downward flow.

3. A method according to claim 1 further including mechanically agitating the upward flow at a plurality of levels in the upward flow.

* * * * *